US007249888B2

(12) United States Patent
Encarnacion et al.

(10) Patent No.: US 7,249,888 B2
(45) Date of Patent: Jul. 31, 2007

(54) POP-UP BAG STUFFER

(75) Inventors: Carlos Encarnacion, Brooklyn, NY (US); Lyudmila Gavurina, Brooklyn, NY (US); Aaron Nirshberg, Brooklyn, NY (US)

(73) Assignee: Barclay Brown Corp., Brooklyn, NY (US)

( * ) Notice: Subject to any disclaimer, the term of this patent is extended or adjusted under 35 U.S.C. 154(b) by 110 days.

(21) Appl. No.: 11/106,959

(22) Filed: Apr. 15, 2005

(65) Prior Publication Data

US 2006/0233472 A1 Oct. 19, 2006

(51) Int. Cl.
*B65D 30/00* (2006.01)
*B65D 33/00* (2006.01)
*B65D 30/16* (2006.01)

(52) U.S. Cl. ..... 383/127; 383/35; 383/104

(58) Field of Classification Search ..... 383/127, 383/104, 33, 35
See application file for complete search history.

(56) References Cited

U.S. PATENT DOCUMENTS

| | | | | |
|---|---|---|---|---|
| 4,993,846 | A * | 2/1991 | Diamond et al. | 383/127 |
| 5,179,600 | A * | 1/1993 | Bailey et al. | 383/127 |
| 5,322,362 | A * | 6/1994 | Smith | 383/127 |
| 5,499,874 | A * | 3/1996 | Tang | 383/127 |
| 6,550,967 | B2 | 4/2003 | Hedaya | |
| 6,698,927 | B2 | 3/2004 | Hedaya et al. | |

* cited by examiner

*Primary Examiner*—Jes F. Pascua
(74) *Attorney, Agent, or Firm*—Notaro & Michalos PC

(57) ABSTRACT

A bag stuffer for placement in a bag, comprising a first panel, a second panel, and an articulated support beam connected between the first and second panels. The articulated beam has a collapsed storage position with the first and second panels substantially adjacent each other and substantially parallel to each other for a storage position of the bag, and an extended or expanded bracing position for holding the first and second panels spaced from each other and for holding the bag in a stuffed display position. The articulated support beam also has at least two beam panels and at least one elastic band for biasing the two beam panels toward each other for biasing the articulated support beam from the collapsed storage toward the expanded bracing position.

2 Claims, 6 Drawing Sheets

FIG. 4
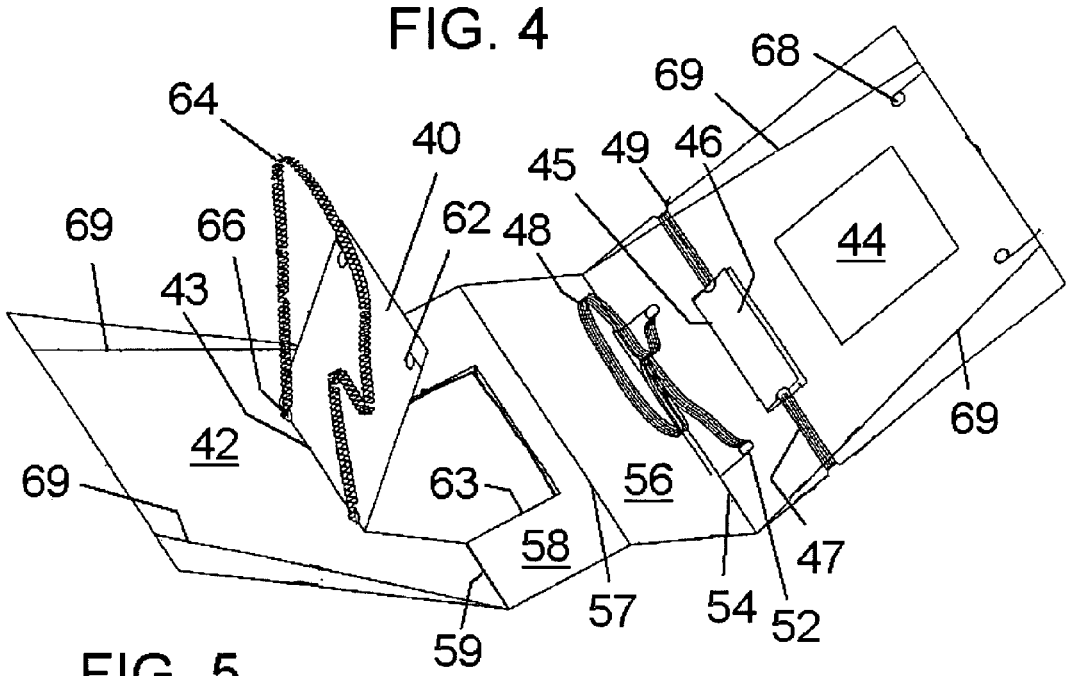
FIG. 5
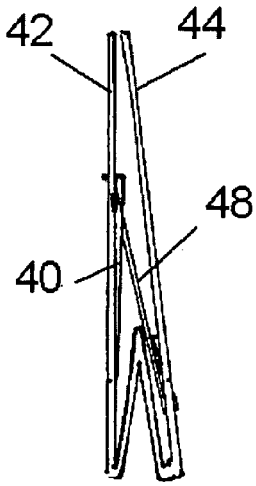
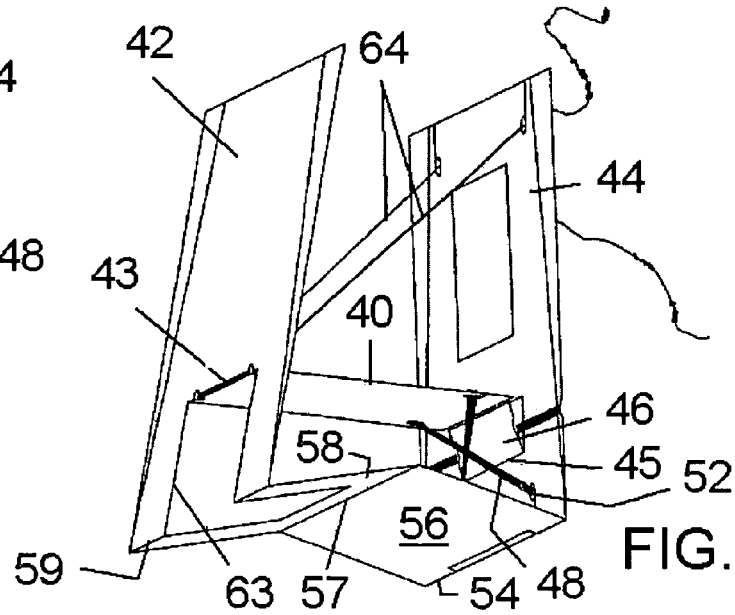
FIG. 6

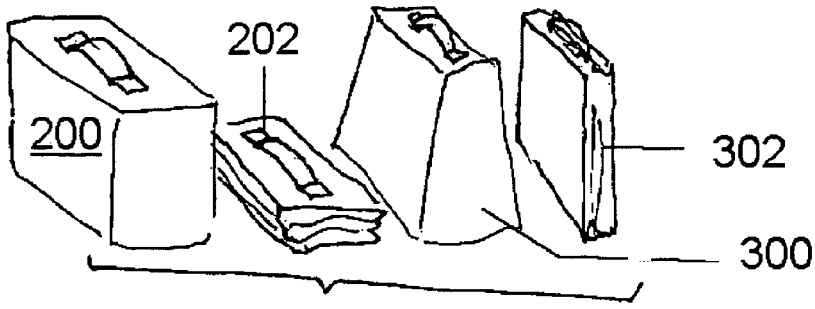
FIG. 12
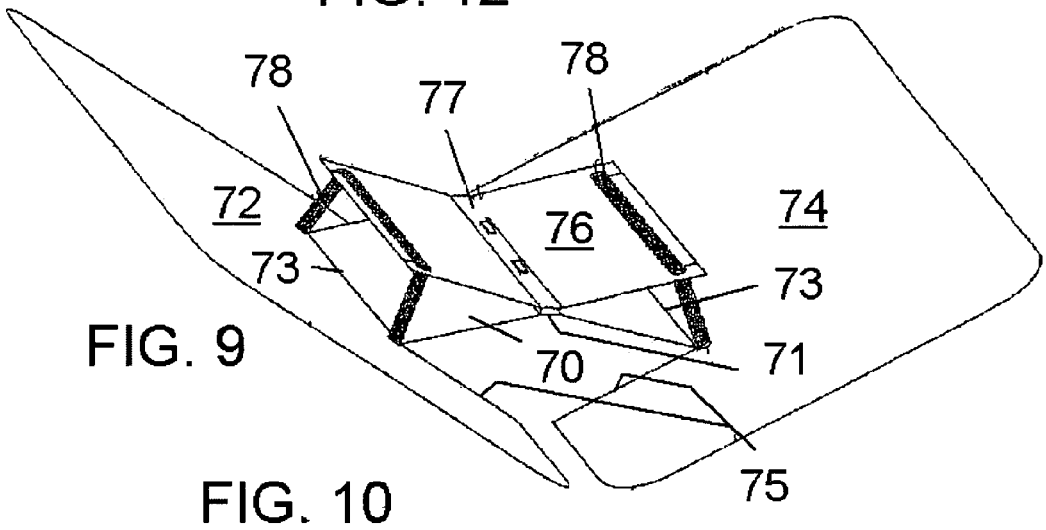
FIG. 9
FIG. 10
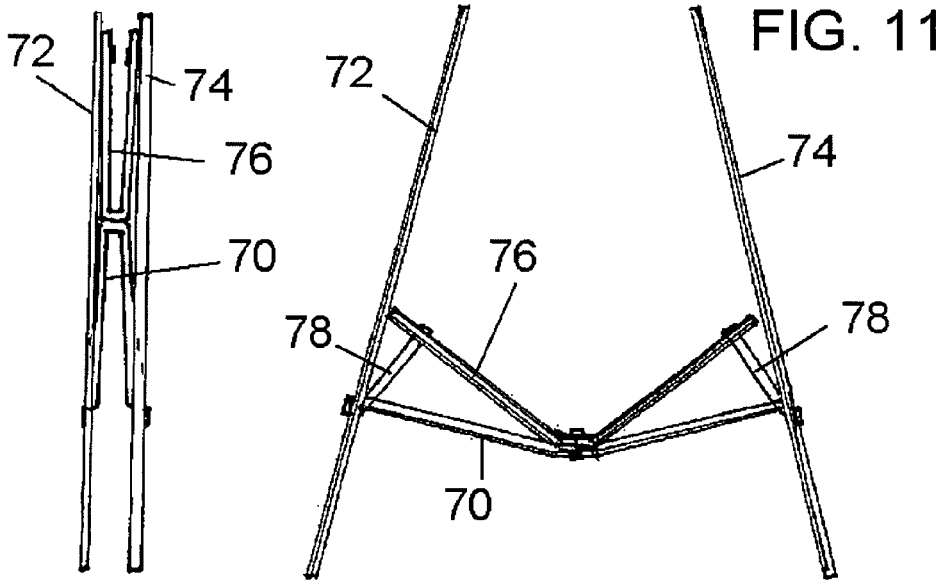
FIG. 11

POP-UP BAG STUFFER

FIELD AND BACKGROUND OF THE INVENTION

The present invention relates generally to the field of bag stuffers having an insert movable from a collapsed orientation which enables compact storage of an expandable bag containing the insert, to an expanded orientation which provides a commercial display of the expandable bag containing the insert, and in particular to such a bag stuffer with an improved pop-up feature.

Bag stuffers or expanders are well-known in the retail art. Each includes an insert movable from a collapsed orientation which enables compact storage, to an expanded orientation which provides a commercial display of the expandable bag containing the insert. Bag stuffers are used with a wide variety of expandable articles which, for reasons of economy, are preferably shipped and stored in a relatively flat or collapsed orientation, but are best presented in commercial displays in an expanded orientation. Such articles include backpacks, baseball bags, basketball bags, beach bags, belt bags, briefcases, cooler bags, cosmetic kits, cross trainer bags, duffle bags, Dop kits, bowling bags, fashion totes, hand bags, locker bags, lunch bags, pilot cases, purses, roller skating bags, snorkeling bags, soft-sided luggage, sports bags, sportsman's gear bags, tackle bags, tennis bags, utility bags and the like. The present invention can be used to stuff any of these bags and any other soft bags not specifically listed, as well.

The assignee of the present application also owns the following US patents that illustrate various types of bag stuffer structures: U.S. Pat. No. 6,698,927 for a Bag Stuffer With Improved Spring; U.S. Pat. No. 6,550,967 for a Bag Stuffer; U.S. Pat. No. 5,542,767 for a Bag Stuffer; and U.S. Pat. No. 5,259,674 for a Bag Expander And Bag Containing Same.

Various rubber band powered bag stuffers or expanders are also know.

See, for example, U.S. Pat. Nos. 5,179,600; 4,993,846; 4,969,751; and 4,946,292.

Other patents of interest to the present invention are: U.S. Pat. Nos. 2,930,557; 3,447,648; 3,902,541; 3,934,803; 4,077,451; 4,141,399; 4,142,564; 4,395,845; 4,993,846; 5,292,197; and 5,322,362.

Also see U.S. Pat. Nos. 5,341,532 and 5,499,874 and U.S. Design Pat. Nos. D316,633; D346,064; and D362,113.

A disadvantage of known bag stuffers is the limitations on the configurations of the expandable bags with which they are useful. Thus while the known bag stuffers are typically useful with relatively shallow, generally rectangular bags, the various planar elements of the insert which abut the bag and are used to force the bag to its expanded orientation could not be used in connection with cylindrical or duffel-type bags or other bags not having parallel sides. Additionally, even where the bag has parallel sides, the biasing means typically cannot separate the planar elements by more than a given distance (determined by the length of the coil spring biasing means) unless an intermediate panel or flap is used (with the biasing means acting on the flap which in turn separates the planar elements). Accordingly, the need remains for a bag stuffer which can expand unusually shaped bags and which, without the presence of intermediate elements (such as flaps), permits the biasing means to move the planar elements abutting the bag to a desired separation greater than the length of the biasing means.

A need still remains for a bag stuffer of increased efficience and reduced cost and complexity for the luggage industry and related fields.

SUMMARY OF THE INVENTION

It is an object of the present invention to provide a bag stuffer which is safe to use, simple and inexpensive to manufacture and deploy.

Another object is to provide a bag stuffer for placement in a bag, the stuffer comprising a first panel, a second panel, and an articulated support beam connected between the first and second panels, the articulated beam having a collapsed storage position with the first and second panels substantially adjacent each other and substantially parallel to each other for a storage position of the bag, and an extended bracing position holding the first and second panels spaced from each other for holding the bag in a stuffed display position, the articulated support beam comprising at least two beam panels and at least one elastic band for biased the two beam panels toward each other for biasing the articulated support beam from the collapsed storage toward the extended bracing position.

Another object of the invention is to provide such a bag stuffer where the at least two beam panels comprise a pair of spaced apart articulated side panels connected between the first and second panels, each side panel containing at least one fold for expanding the side panel from the collapsed storage position to the expanded bracing position, and at least one intermediate panel connected between the first and second panels and positioned between the side panels, the intermediate panel containing at least one fold for expanding from the collapsed storage position to the expanded bracing position, the at least one fold of the intermediate panel in its expanded bracing position being bent at an angle of other than 180 degrees for holding the side panels apart in their expanded bracing position, the at least one elastic band being engaged between the side panels for biasing the side panels toward each other and toward the intermediate panel.

Another object of the invention is to provide such a bag stuffer where the at least two beam panels comprise a pair of spaced apart articulated side panels connected between the first and second panels, each side panel containing at least one fold for expanding the side panel from the collapsed storage position to the expanded bracing position, and the at least one elastic band being engaged between the side panels for biasing the side panels toward each other.

Another object of the invention is to provide such a bag stuffer wherein one of the at least two beam panels comprise a spanning panel connected to the first panel at a fold, the other of the at least two beam panels comprising a stop panel connect to the second panel at a fold, the elastic band being engaged between the spanning panel and the second panel for pulling the spanning panel toward the stop panel for biasing the support beam toward the extended bracing position, the extended bracing position being established when the spanning panel engages the stop panel.

A still further object of the invention is to provide such a bag stuffer wherein one of the at least two beam panels comprise a spanning panel connected between the first and second panels at a fold at each of the first and second panels, the spanning panel having at least one fold for bending the spanning panel into the collapsed storage position, the other of the at least two beam panels comprising a stop panel connect to the spanning panel near the fold in the spanning panel, the stuffer having at least two elastic bands each engaged between the stop panel and one of the first and second panels for pulling the stop panel toward the spanning panel for biasing the support beam toward the extended bracing position.

The various features of novelty which characterize the invention are pointed out with particularity in the claims annexed to and forming a part of this disclosure.

For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 4 is a perspective view of a second embodiment of the bag stuffer of the present invention in a position during its manufacture;

FIG. 5 is a side view of the embodiment of FIG. 4, showing the stuffer in its collapsed, storage position;

FIG. 6 is a perspective view of the embodiment of FIG. 4, showing the bag stuffer in its expanded display position;

FIG. 9 is a perspective view of a third embodiment of the bag stuffer of the present invention in a position during its manufacture;

FIG. 10 is a side view of the embodiment of FIG. 9, showing the stuffer in its collapsed, storage position;

FIG. 11 is a side view of the embodiment of FIG. 9, showing the bag stuffer in its expanded display position; and FIG. 12 is a composite perspective view showing two bags stuffed according to the present invention and in their respective expanded display, and collapsed storage, positions.

DESCRIPTION OF THE PREFERRED EMBODIMENTS

Figure 1:
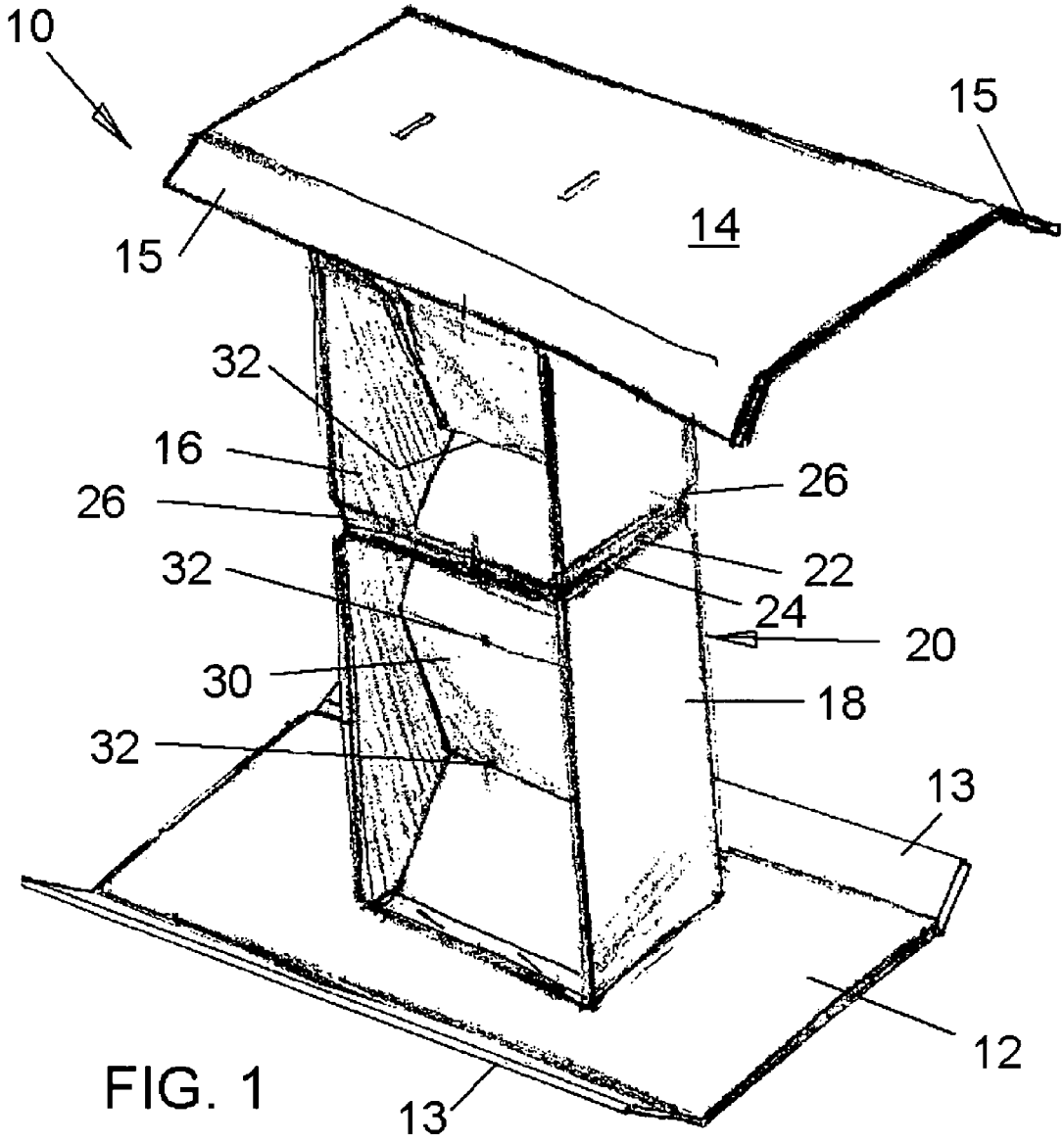
FIG. 1 is a perspective view of one embodiment of the bag stuffer of the present invention in its expanded and braced display position.

Referring to the drawings, the invention embodied in FIG. 1 is a bag stuffer generally designated 10 for placement in a bag such as a bag 200 in FIG. 12, the stuffer comprising a first or bottom panel 12, a second or top panel 14, and an articulated support beam generally designated 20 connected between the first and second panels. The articulated beam 20 has a collapsed storage position shown in FIG. 3, with the first and second panels 12, 14, substantially adjacent each other and substantially parallel to each other for a storage position of the stuffer and the bag around the stuffer (at 202 in FIG. 12). The articulated beam 20 also has an extended bracing position as shown in FIG. 1, holding the first and second panels 12, 14, spaced from each other for holding the bag in a stuffed display position (200 in FIG. 12).

The articulated support beam 20 comprises at least two beam panels and at least one elastic band for biasing the two beam panels toward each other for biasing the articulated support beam from the collapsed storage, toward the extended bracing position. This is a feature shared by all embodiments of the invention disclosed here.

Figure 2:
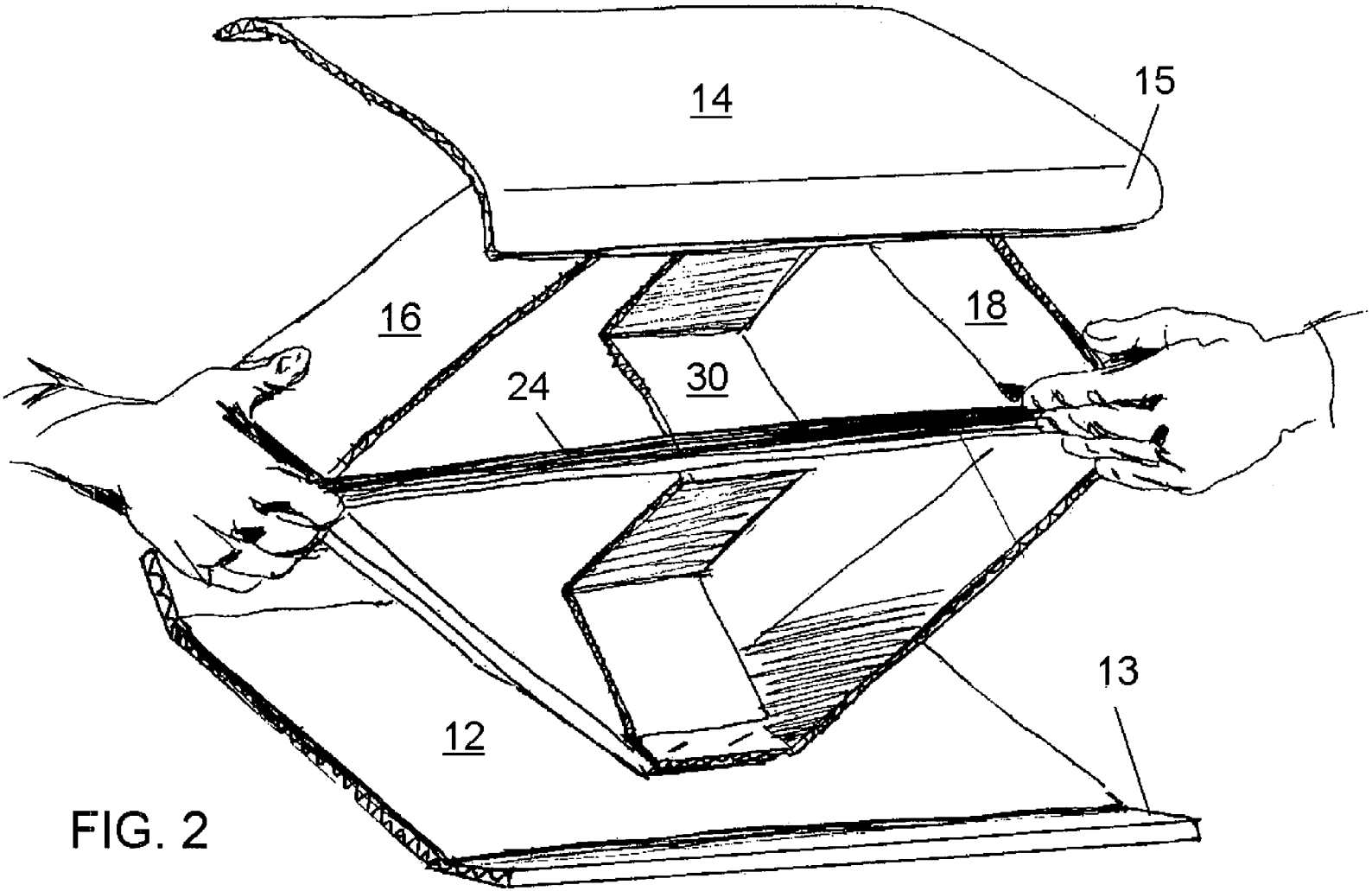
FIG. 2 is a perspective view of the embodiment of FIG. 1, as the stuffer is being moved from its expanded position to its storage position.
Figure 3:
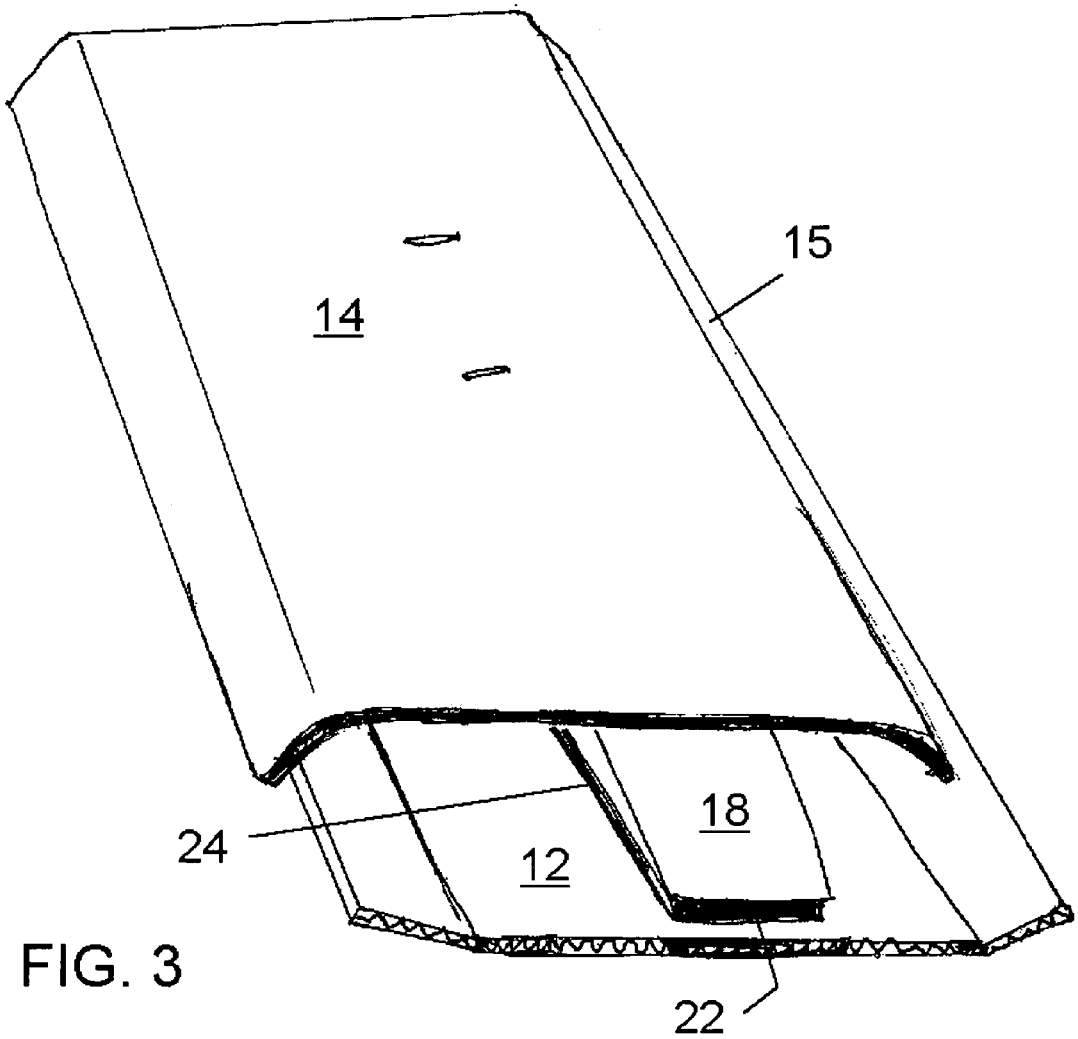
FIG. 3 is a perspective view of the embodiment of FIG. 1, showing the bag stuffer of the present invention in its collapsed, storage position.
Figure 7:
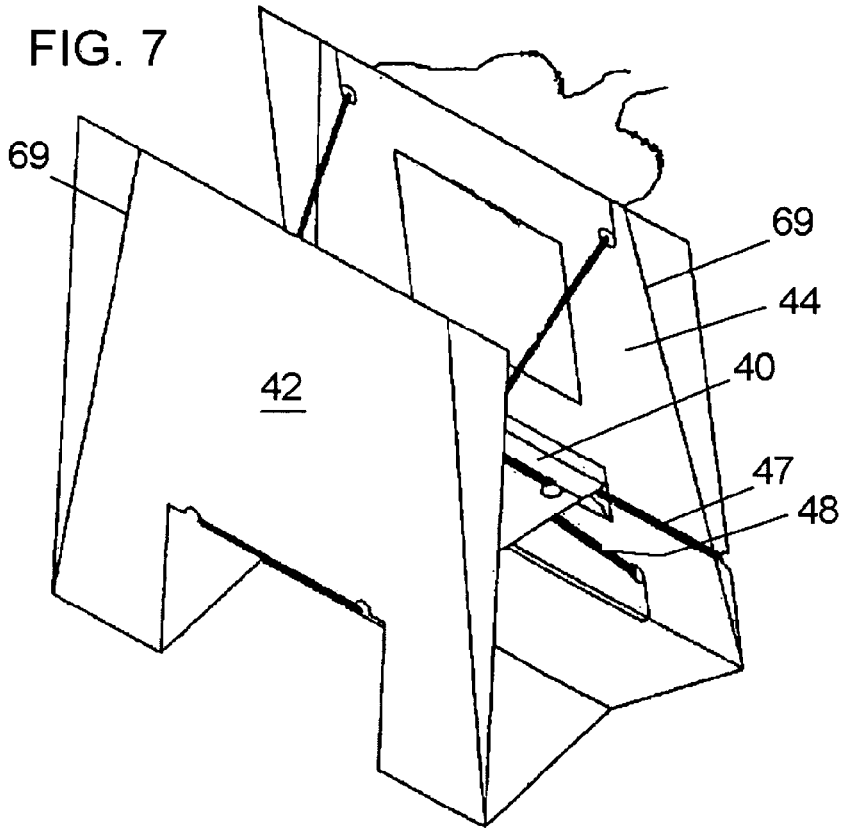
FIG. 7 is a perspective view of the embodiment of FIG. 4, showing the bag stuffer in its expanded display position but taken at a different angle from the view of FIG. 6.
Figure 8:
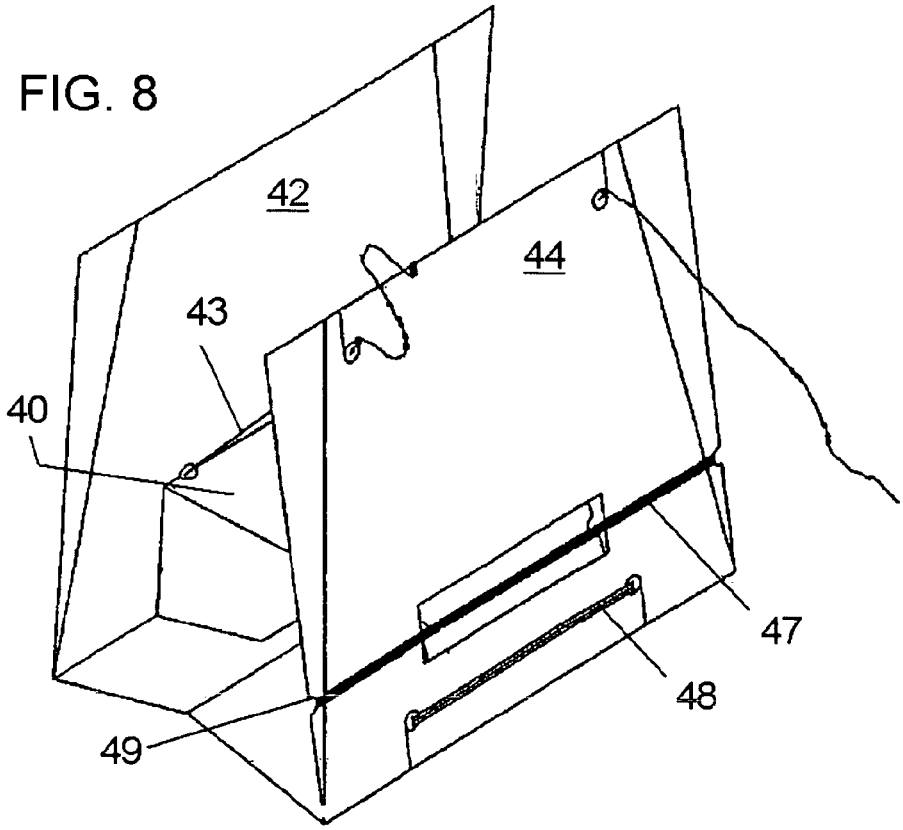
FIG. 8 is a perspective view of the embodiment of FIG. 4, showing the bag stuffer in its expanded display position but also taken at a different angle from the view of FIG. 6.

In the embodiment of FIGS. 1-3, the articulated support beam 20 comprises a pair of spaced apart articulated side panels 16 and 18, connected between the first and second panels 12 and 14. Each side panel 16, 18, contains at least one fold 22, preferably parallel to the planes of panels 12 and 14, and about midway between the first and second panels, for expanding each side panel from the collapsed storage position of FIG. 3, to the expanded bracing position of FIG. 1, through an intermediate position shown in FIG. 2. An elastic band, e.g. a rubber band 24, is engaged around the side panels 16 and 18 at the folds 22. The band is kept in place by a pair of semi-circular notches 26 at the opposite sides of each side panel, at opposite ends of each fold 22.

According to one embodiment of the invention, the forgoing foldable side panels 16, 18 and band 24, compete the articulated support beam. The side panels at pulled to their extended position of FIG. 1 to move the panels 12 and 14 apart and maintain the expanded display position for the bag containing the stuffer as in FIG. 12 at 200.

According to another embodiment of the invention where a large stuffer is required for a large bag and the biased side panels alone may be not sufficiently strong the expand and hold the bag expanded, the articulated support beam must also include at least one intermediate panel 30 connected between the first and second panels 12 and 14, and positioned between the side panels 16 and 18.

The intermediate panel contains at least one, but preferably more folds 32 for expanding from the collapsed storage position of FIG. 3, through the intermediate position of FIG. 2, to the expanded bracing position of FIG. 1. The at least one fold of the intermediate panel in its expanded bracing position is bent at an angle of other than 180 degrees as shown in FIG. 1, for holding the side panels apart but in their expanded bracing position. In the collapsed position the intermediate panel 30 is stored in a zig-zag folded condition between the top and bottom panels 12 and 14.

The at least one elastic band 26 engaged around and between the side panels 16, 18, is also for biasing the side panels toward each other and against the intermediate panel, which, in its slightly bend condition, acts like a strong truss for the support beam 20.

The top and bottom panels 12, 14 each also have a pair of side flanges 13 and 15 which are connected at one or more folds to the may bodies of the panels and can be folded in either direction to conform to the interior sides of the bag to be stuffed. Extension structures (not shown) can also be used at the ends of the stuffer 10 of FIGS. 1-3 to better fill longer bags such as duffle bags.

The panels of all embodiments of the invention are preferably made of corrugated cardboard and may use recycled and printed cardboard since the stuffers are not viewed in normal use but are inside the bag. Other flat stock material can alternatively be used or cardboard can be combined with other materials in one stuffer. All connections between the panels can be made by staple or other simple fastener or by glue or other adhesive. Where possible some panels can be created by cutting and folding sections of other panels as will be understood by the person of ordinary skill in this field, and as will become apparent, especially in some of the further embodiments to be described later in this disclosure.

Any flexible bag of any size can be accommodated by a suitably dimensioned stuff of one of the embodiments disclosed here. This includes, but is not limited to, the types of bags listed a the beginning of this disclosure.

Another embodiment of the invention is shown in FIGS. 4-8.

In this embodiment, one of the at least two beam panels comprise a spanning panel 40 connected to the first panel 42 at a fold 43. The other of the at least two beam panels comprises a stop panel 46 connected to the second panel 44 at a fold 45. An elastic band 48 is engaged between the outer end of spanning panel 40, and the second panel 44 at a location below the stop panel 46 as shown in FIG. 6, for pulling the spanning panel 40 toward the stop panel 46 and for biasing the support beam toward the extended bracing position illustrated by FIGS. 6, 7 and 8. The extended bracing position is established when the spanning panel 40 engages the top of the stop panel 46. The stop panel 46 is held away from the second panel 44 by a second elastic band 47 that engages around the second panel and is captured in a pair of notched 49 at the sides edges of panel 44.

Elastic band 48 is captured in a pair of slotted holes 52 cut near the base of panel 44, near a fold 54 between the panel 44 and one of two base panels 56 and 58. Fold 57 is between these base panels and a fold 59 is between panel 58 and first panel 42. A pair of slotted holes 62 on opposite sides of the outer end of spanning panel 40 also capture the elastic band 48 for securing the band between panels 40 and 44 as shown n FIG. 6.

Although not always required, a string 64 that is either a closed loop or has open ends is captured in slotted holes 66 at the opposite sides of fold 43, and can be captured in slotted holes 68 near the top of panel 44 to pull and hold first and second panels 42, 44, toward each other. For smaller stuffers of this design, the elastic band 48 will exert enough force to keep panels 42 and 44 biased together.

Angled folds 69 at the top side edged of panels 42 and 44 (see FIG. 7 for example) allow these panels to be bent from a purely rectangular shape, to a rhombus or other shape to better stuff bags that tapper toward the top as shown at 300 in FIG. 12, such as for handbags and tote bags.

For economy of material and manufacture, spanning panel 40 is cut out of first panel 42 and base panel 58, to leave a cutout area 63, before the fold 59 is made to keep panel 40 free of folds and therefore strong.

A further embodiment of the invention is illustrated in FIGS. 9-11, where the collapsed storage position is shown in FIG. 10 and can be placed inside a bag like that at 302 in FIG. 12, and where the expanded display position is shown at FIG. 11 and corresponds to the bag at 300 in FIG. 12, for example.

In this embodiment, the at least two beam panels comprise a spanning panel 70 connected between the first and second panels 72 and 74 at a fold 73 at each of the first and second panels. Spanning panel 70 may be cut out of the material at the bases of panels 72 and 74 to leave cutout areas 75. The spanning panel 70 has at least one fold 71 for bending the spanning panel into the collapsed storage position shown in FIG. 10. The other of the at least two beam panels comprises a stop panel 76 connect e.g. by staples, to the spanning panel 70 near the middle and near the fold 71 in the spanning panel. The stop panel 76 has its our fold or folds 77. This stuffer has at least two elastic bands 78 each engaged between the outer ends of the stop panel 76 and one of the first and second panels 72, 74 for pulling the stop panel toward the spanning panel for biasing the support beam toward the extended bracing position. Slotted holes are provided for capturing the elastic bands.

To explain further, when in the collapsed position of FIG. 10, the stop panel 76 is folded with its opposite outer ends up and the elastic bands stretched far between these ends of panel 76, and the base of the now lower outer ends of panel 70 at each of the first and second panels 72 and 74. In this position spanning panel 70 is folded with its opposite ends down and its middle that is connected to middle of stop panel 76, upward.

When first and second panels 72, 74 are allowed to move apart, e.g. because an outer shrink wrapping around the collapsed bag of FIG. 12 at 302 is removed, the elastic bands will pull the outer ends of panel 76 downwardly causing the panels 72 and 74 to spread to the position of FIG. 11, and bracing these panels in that position.

For all embodiments of the invention, when the pressure holding the stuffer in the collapsed position is removed, e.g. when the tight wrapping around the collapsed, storage positioned bag with the stuffer therein is removed, the elastic band or bands pop the stuffer into the expanded position with vigor to also expand the bag into the display position, e.g. of FIGS. 1, 6 and 11. The movement for collapsing the stuffer, for example as shown in FIG. 2, is reversed but with great speed and the structure of each stuffer in the expanded position is rigid and secure for maintaining the bag in its display position. Despite this functionality, each stuffer is inexpensive both in material, e.g. recycled cardboard, and in manufacturing, using simple cutout shaped and staples, for example.

While specific embodiments of the invention have been shown and described in detail to illustrate the application of the principles of the invention, it will be understood that the invention may be embodied otherwise without departing from such principles.

What is claimed is:

1. A bag placement in a bag, the stuffer comprising a first panel, a second panel, and an articulated support beam connected between the first and second panels, the articulated beam having a collapsed storage position with the first and second panels substantially adjacent each other and substantially parallel to each other for a storage position of the bag, and an expanded bracing position holding the first and second panels spaced from each other for holding the bag in a stuffed display position, the articulated support beam comprising at least two beam panels and at least one elastic band for biasing the two beam panels toward each other and for biasing the articulated support beam from the collapsed storage toward the expanded bracing position, the at least two beam panels comprising a pair of spaced apart articulated side panels connected between the first and second panels, each side panel containing at least one fold for expanding the side panel from the collapsed storage position to the expanded bracing position, and at least one intermediate panel connected between the first and second panels and positioned between the side panels, the intermediate panel containing at least one fold for expanding from the collapsed storage position to the expanded bracing position, the at least one fold of the intermediate panel in its bracing position being bent at an angle of other than 180 degrees for holding the side panels apart and in their expanded bracing position, the at least one elastic band being engaged between the side panels for biasing the side panels toward each other and toward the intermediate panel.

2. A bag stuffer for placement in a bag, the stuffer comprising a first panel, a second panel, and an articulated support beam connected between the first and second panels, the articulated beam having a collapsed storage position with the first and second panels substantially adjacent each other and substantially parallel to each other for a storage position of the bag, and an expanded bracing position holding the first and second panels spaced from each other for holding the bag in a stuffed display position, the articulated support beam comprising at least two beam panels and at least one elastic band for biasing the two beam panels toward each other and for biasing the articulated beam from the collapsed storage toward the expanded bracing position, and wherein one of the at least two beam panels comprise a spanning panel connected between the first and second panels at a first fold at each of the first and second panels, the spanning panel having at least one second fold for bending the spanning panel into the collapsed storage position, the other of the at least two beam panels comprising a stop panel connect to the spanning panel near the second fold in the spanning panel, the stuffer having at least two elastic bands each engaged between the stop panel and one of the first and second panels for pulling the stop panel toward the spanning panel and for biasing the support beam toward the expanded bracing position.

* * * * *